US005526005A

United States Patent [19]

Koo

[11] Patent Number: 5,526,005

[45] Date of Patent: Jun. 11, 1996

[54] ANTENNA HOUSING OF A PORTABLE TRANSCEIVER

[75] Inventor: Gwan Y. Koo, Kyeongki-do, Rep. of Korea

[73] Assignee: Ace Antenna Corporation, Rep. of Korea

[21] Appl. No.: 271,461

[22] Filed: Jul. 7, 1994

[51] Int. Cl.[6] ..... H01Q 1/24

[52] U.S. Cl. ..... 343/702; 343/749; 343/841; 343/901

[58] Field of Search ..... 343/702, 749, 343/841, 872, 873, 878, 880, 883, 895, 900, 901, 903; H01Q 1/24

[56] References Cited

U.S. PATENT DOCUMENTS

| | | | |
|---|---|---|---|
| 4,435,713 | 3/1984 | Gasparaitis et al. | 343/702 |
| 4,890,114 | 12/1989 | Egashira | 343/702 |
| 5,030,964 | 7/1991 | Nakanishi | 343/901 X |
| 5,243,355 | 9/1993 | Emmert et al. | 343/895 X |
| 5,245,350 | 9/1993 | Sroka | 343/702 |
| 5,258,772 | 11/1993 | Inanaga et al. | 343/895 |

FOREIGN PATENT DOCUMENTS

| | | | |
|---|---|---|---|
| 1267291 | 5/1968 | Germany | 343/749 |
| 0098804 | 5/1987 | Japan | 343/749 |

*Primary Examiner*—Donald T. Hajec
*Assistant Examiner*—Steven Wigmore
*Attorney, Agent, or Firm*—Spencer & Frank

[57] ABSTRACT

The present invention relates to an antenna housing of a portable transceiver, more particularly to an antenna housing for a portable transceiver for improving a receiving level and protecting against fracture and damage to an antenna. The present invention provides an antenna housing of a portable transceiver comprising: an antenna cover having a pair of annular rims at its lower part and protecting an antenna; a tip fixed to an upper end of the antenna; a spring inserted between the annular rims; a pair of cover supporters having a guide groove to guide motion of the spring in the longitudinal direction, a number of locking grooves which are formed at a predetermined interval deeper than the guide groove, and a catching jut in an upper part of the cover supporters; and a connector connecting a lower part of the cover supporters and a transceiver.

9 Claims, 3 Drawing Sheets

ANTENNA HOUSING OF A PORTABLE TRANSCEIVER

BACKGROUND OF THE INVENTION

The present invention relates to an antenna housing of a portable transceiver, and more particularly to an antenna housing for a portable transceiver for improving a receiving level and protecting against fracture and damage to an antenna.

It is known that an antenna housing of a portable transceiver can be inserted into an inside of the transceiver. Most of these known antenna housing require an antenna cover having a locking protuberance for protecting the antenna and a cover supporter having a guide groove and a number of locking grooves for locking the locking protuberance. So, the antenna cover with the antenna artificially moves out of the transceiver along the guide groove of the cover supporter in order to receive and transmit a radio frequency signal.

If the call is finished, the antenna cover with the antenna artificially moves down along the guide groove. That is, the locking protuberance moves along the guide groove snaps into the locking Groove for fixing the antenna cover at a predetermined position. Also, a length of the antenna is not changed, with the antenna cover moving up and down.

However, prior art the antenna housing has a disadvantage that when the looking protuberance snaps into the locking groove, it is impossible for the antenna cover to rotate in the cover supporter, which results in breaking of the antenna cover and the antenna, Also, because the antenna moves up and down without changing its length, there is another problem that an entire length of the housing increases. Furthermore, there is another problem that a receiving level decreases, because the hands of a user, as well as the circuits in the transceiver, have an effect on the antenna.

Accordingly, it is an object of the invention to provide an antenna housing of a portable transceiver having a spring which permits a rotation of the antenna cover. Another object of the invention is to provide an antenna housing of a portable transceiver having a shielding pipe which decreases the effect of the circuits in the transceiver and the hands of a user and thereby an increases the receiving level.

A further object of the invention is to provide an antenna housing of a portable transceiver which permits a change of an antenna length and thereby a seduction of the housing length.

SUMMARY OF THE INVENTION

The invention relates to an antenna housing of a portable transceiver comprising: an antenna cover having a pair of annular rims at its lower part and protecting an antenna; fixed to an upper end of the antenna; a spring inserted between the annular rims; a cover supporter having a guide groove to guide a motion of the spring in the longitudinal direction, a number of locking grooves at a predetermined interval deeper than said guide groove, and a catching jut in its upper part, and supporting the antenna cover; and a connector connecting a lower part of the cover supporter and a transceiver.

BRIEF DESCRIPTION OF THE DRAWINGS

For understanding of the nature and objects of the invention, reference should be had to the following detailed description taken in conjunction with the accompanying drawings in which.

DETAILED DESCRIPTION OF THE INVENTION

Figure 1:
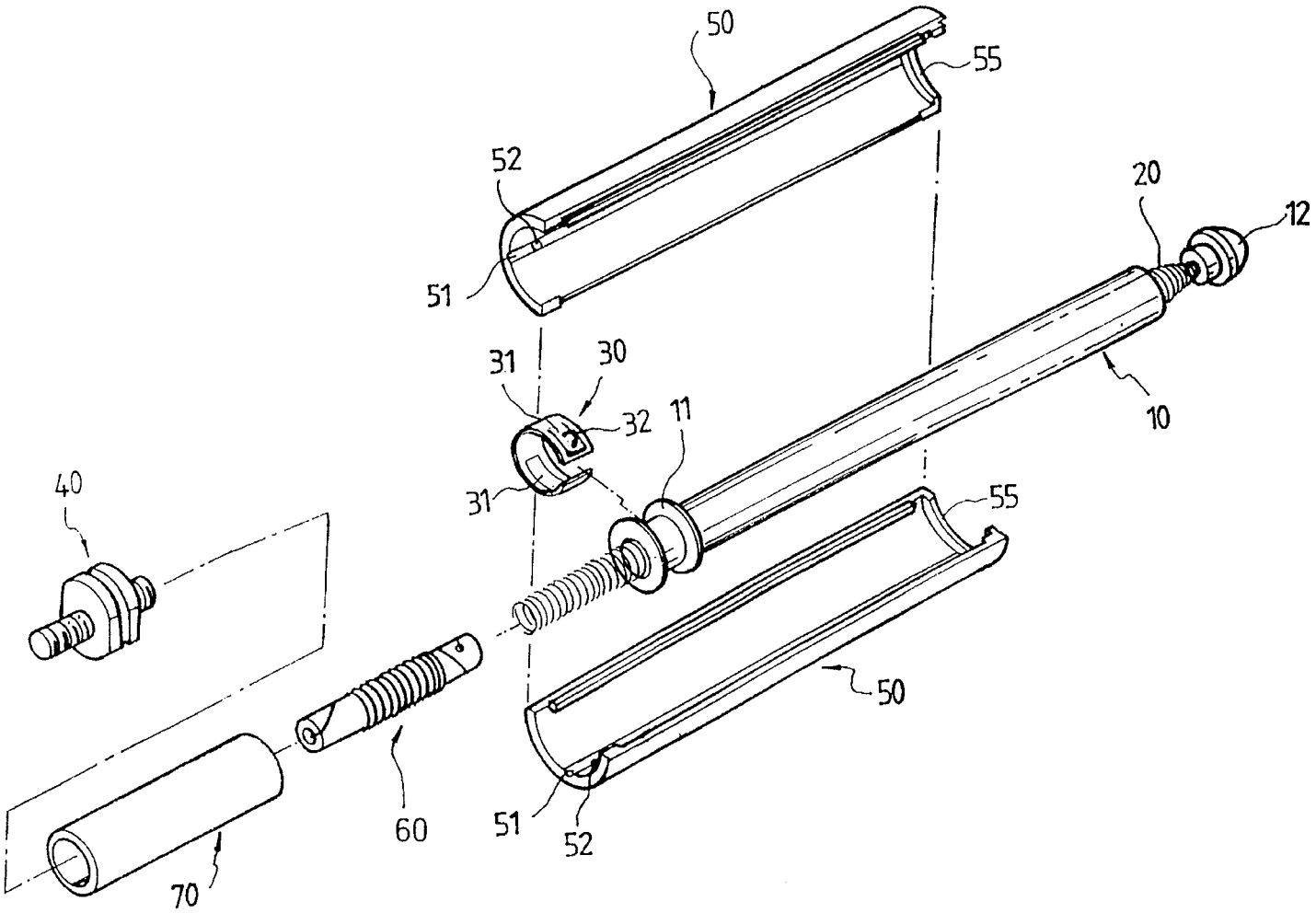
FIG. 1 is an exploded view in perspective of an housing of a portable transceiver according to an embodiment of the invention.
Figure 2A:
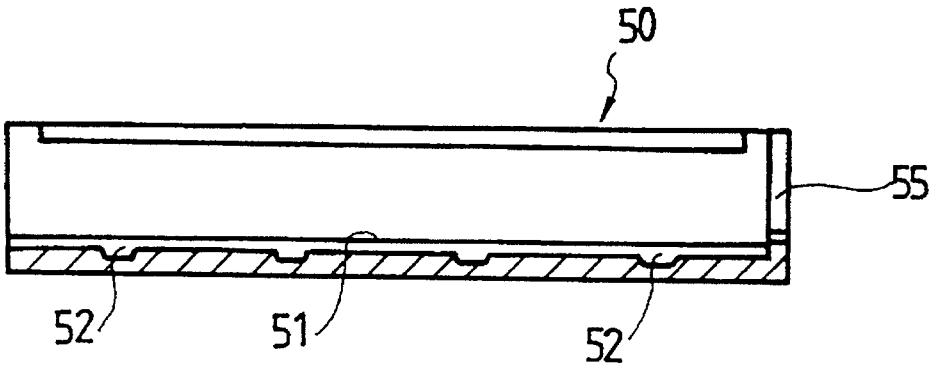
FIG. 2A is a vertical sectional view of a cover supporter according to an embodiment of the invention.
Figure 2B:
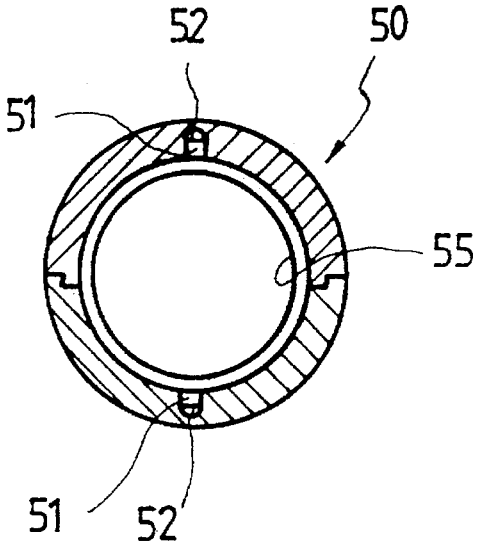
FIG. 2B is a fragmentary cross-sectional view of a combined cover supporter according to an embodiment of the invention.
Figure 3:
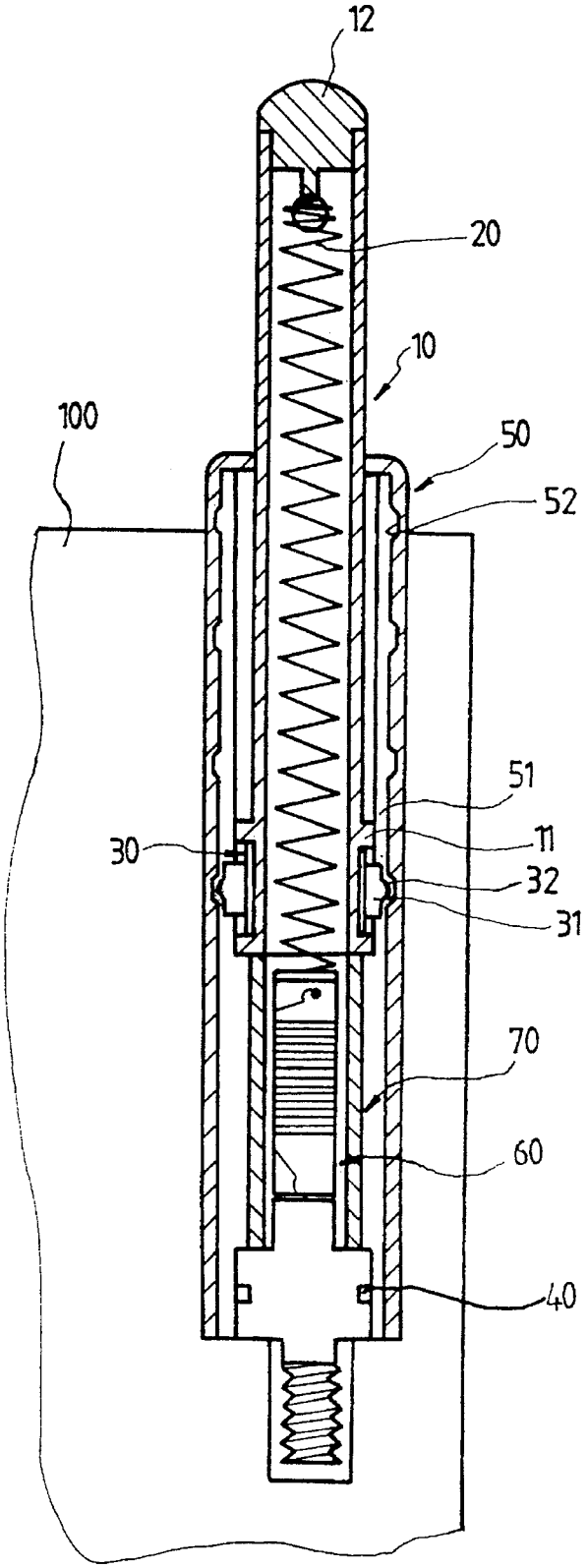
FIG. 3 is a vertical sectional view of a combined antenna housing of a portable transceiver according to an embodiment of the invention.

Referring to FIG. 1, FIG. 2A and FIG. 2B, a cover, comprised, for example, of a synthetic resin material, 10 has a pair of annular rims 11 at its lower part to protect an antenna 20. Antenna 20 comprises, for example, a coiled antenna. A tip 12 is fixed to the upper end of the antenna 20. An annular spring 30, comprised of for example, an elastic metal material is inserted between the annular rims 11. The annular spring 30 has an elastic strip 32 forming a locking protuberance 31. A pair of cover supporters 50, comprised for example, of the same material as cover 10, has a guide groove 51 to guide a motion of the spring 30 in the longitudinal direction. The supporters 50 further have a number of locking grooves (i.e., indentations) 52 which are formed in the guide groves 51 at a predetermined interval and are deeper than the guide groove 51. A catching jut 55 is formed in upper part of supporters 50. A connector 40 fixes the pair of cover supporters 50 together by using adhesives, and is used to connect the antenna 20 together with a transceiver 100 (FIG. 3). In order to match impedance for a receiving frequency, a loading coil 60 is combined with the antenna 20, and is fixed at the connector 40. A shielding pipe 70 , which is formed of a conducting material, for example, copper, nickel etc., is fixed at the connector 40, and surrounds the loading coil 60. The cover supporters 50 adhere to each other by using the adhesives, so that the supporters 50 surround the antenna cover 10 and the connector 40.

Referring to FIG. 3, the antenna cover 10 with the antenna 20 artificially moves out of the transceiver 100 and, the cover supporter 50 to receive and transmit a radio frequency signal. Therefore, the elastic strip 31 moves up along the guide groove 51 and the locking protuberance 32 moves from the locking groove 52. As the antenna cover 10 is pulled out, the locking protuberance 32 is lockingly inserted into subsequent locking grooves 52, i.e., the locking protuberance 32 and locking groove 52 form a detent, until the upper annular rim 11 abuts against is caught catching jut 55. The antenna cover 10 is freely rotated since the spring 30 engaged with the guide groove 51 (and is hence prevented from rotating) is separate from the antenna cover 10. Furthermore, as the antenna cover 10 moves up, a length of the antenna 20 increase.

If the call is finished, the antenna cover 10 artificially moves down along the guide groove 51 until the lower annular rim 11 abuts against the tip of the shielding pipe 70.

As described above, the antenna housing of the portable transceiver according to an embodiment of the invention has the following benefits in contrast with the prior art:

1) The antenna cover, which can be freely rotated prevents itself and the antenna from damage and fracturing.

2) By and to the shielding pipe, the effect of circuits of the transceiver and the hands of a user decreases, thereby increasing the receiving level.

3) The length of the antenna is changeable; thereby the length of the housing can be reduced.

What is claimed is:

1. An antenna housing of a portable transceiver, comprising:

an antenna having a tip fixed to an end thereof;

an antenna cover having an end with a pair of annular rims attached thereto, said antenna cover protecting said antenna;

a spring inserted between the annular rims, said spring and said antenna cover being rotatable relative to each other about a longitudinal axis of said antenna cover;

a pair of cover supporters connected together to surround said antenna cover and said spring, and each having:

a guide groove for guiding a motion of said spring and said antenna cover in a longitudinal direction and preventing rotation of said spring around the longitudinal axis;

a plurality of locking grooves formed at predetermined intervals along the guide groove, and having a depth deeper than a depth of the guide groove, the locking grooves releasably locking said spring and said antenna cover in the longitudinal direction; and a catching jut formed at a first end of said cover supporter for engaging one of said annular rims to limit a movement of said antenna cover in the longitudinal direction; and a connector connecting a second end of said cover supporters to the portable transceiver.

2. The antenna housing as defined in claim 1, wherein said spring includes an elastic strip forming a locking protuberance, said elastic strip being movable along a respective guide groove so that said locking protuberance snaps into a respective locking groove for releasably locking said spring and said antenna cover in the longitudinal direction.

3. The antenna housing as defined in claim 1, wherein said antenna is operatively connected to said connector.

4. The antenna housing as defined in claim 1, wherein said antenna has a first end and a second end, said tip being fixed to the first end; further comprising a loading coil attached to the second end of said antenna for matching an impedance for a receiving frequency.

5. The antenna housing as defined in claim 4, wherein said loading coil is fixed to said connector.

6. The antenna housing as defined in claim 4, further comprising a shielding pipe fixed to said connector and surrounding said loading coil.

7. The antenna housing as defined in claim 6, wherein said shielding pipe is comprised of a conducting material.

8. The antenna housing as defined in claim 1, further comprising a shielding pipe fixed to said connector and surrounding a lower portion of said antenna.

9. The antenna housing as defined in claim 8, wherein said shielding pipe is comprised of a conducting material.

* * * * *